US009435186B2

(12) United States Patent
Bakke

(10) Patent No.: US 9,435,186 B2
(45) Date of Patent: Sep. 6, 2016

(54) SUB SEA PROCESSING SYSTEM

(75) Inventor: William Bakke, Royken (NO)

(73) Assignee: STATOIL PETROLEUM AS, Stavanger (NO)

( * ) Notice: Subject to any disclaimer, the term of this patent is extended or adjusted under 35 U.S.C. 154(b) by 1025 days.

(21) Appl. No.: 12/441,430

(22) PCT Filed: Oct. 19, 2007

(86) PCT No.: PCT/NO2007/000373

§ 371 (c)(1),
(2), (4) Date: Sep. 10, 2009

(87) PCT Pub. No.: WO2008/051087

PCT Pub. Date: May 2, 2008

(65) Prior Publication Data

US 2010/0032164 A1 Feb. 11, 2010

(30) Foreign Application Priority Data

Oct. 27, 2006 (NO) ..... 20064918

(51) Int. Cl.
*E21B 43/01* (2006.01)
*E21B 43/40* (2006.01)
(Continued)

(52) U.S. Cl.
CPC ..... *E21B 43/40* (2013.01); *E21B 33/0355* (2013.01); *E21B 36/00* (2013.01); *E21B 43/01* (2013.01); *E21B 43/36* (2013.01)

(58) Field of Classification Search
CPC ..... E21B 43/017; E21B 43/36; E21B 2043/0115; E21B 43/24; E21B 43/40; E21B 36/00; E21B 33/0355; E21B 43/01
USPC ..... 166/357, 366, 344, 267, 266, 272.1, 60, 166/61
See application file for complete search history.

(56) References Cited

U.S. PATENT DOCUMENTS 2,217,749 A * 10/1940 Hewitt ..... 166/266
2,358,920 A * 9/1944 Garrison ..... 166/266
(Continued)

FOREIGN PATENT DOCUMENTS

WO 02/18746 3/2002
WO WO 02/18746 A1 * 3/2002 ..... E21B 43/40
(Continued)

OTHER PUBLICATIONS

International Search Report issued Jan. 31, 2008 in the International (PCT) Application of which the present application is the U.S. National Stage.
(Continued)

*Primary Examiner* — James G Sayre
(74) *Attorney, Agent, or Firm* — Wenderoth, Lind & Ponack, L.L.P.

(57) ABSTRACT

A sub-sea processing system for the production of oil and/or gas from one or more production wells (1), especially wells producing heavy oil in deep water and with high viscosity. The system includes, beyond the production wells (1), one or more injection wells (2) for the injection of produced water, a separator (3), a production pump (4), a water injection and circulation pump (5) and a heating arrangement (6). A water circulation and injection pipe loop (7) is provided to interconnect the separator (3), the injection and circulation pump (5), the heating arrangement (6), the flow control device (11), and the wells (1, 2) enabling circulation of heated water to the wells (1, 2) via the separator (3) and heating arrangement (6).

18 Claims, 1 Drawing Sheet

(51) Int. Cl.

| | |
|---|---|
| ***E21B 33/035*** | (2006.01) |
| ***E21B 36/00*** | (2006.01) |
| ***E21B 43/36*** | (2006.01) |

(56) References Cited

U.S. PATENT DOCUMENTS

| | | | | | |
|---|---|---|---|---|---|
| 2,386,036 | A | * | 10/1945 | Cross | 166/266 |
| 2,809,698 | A | * | 10/1957 | Bond et al. | 166/267 |
| 2,880,801 | A | * | 4/1959 | Crump | 166/252.1 |
| 3,474,863 | A | * | 10/1969 | Deans et al. | 166/266 |
| 3,504,741 | A | * | 4/1970 | Talley et al. | 166/356 |
| 3,590,919 | A | | 7/1971 | Talley, Jr. | |
| 3,707,189 | A | * | 12/1972 | Prats | 166/272.3 |
| 3,768,559 | A | | 10/1973 | Allen et al. | |
| 4,665,989 | A | * | 5/1987 | Wilson | 166/302 |
| 4,679,598 | A | | 7/1987 | Jee | |
| 5,490,562 | A | * | 2/1996 | Arnold | 166/267 |
| 6,772,840 | B2 | | 8/2004 | Headworth | |
| 2003/0056954 | A1 | | 3/2003 | Headworth | |
| 2004/0149445 | A1 | | 8/2004 | Appleford et al. | |
| 2005/0145388 | A1 | * | 7/2005 | Hopper | 166/357 |

FOREIGN PATENT DOCUMENTS

| | | |
|---|---|---|
| WO | 02/092961 | 11/2002 |
| WO | 03/086976 | 10/2003 |

OTHER PUBLICATIONS

Patent Cooperation Treaty (PCT) Written Opinion of the International Search Authority (in English language) issued Jan. 31, 2008 in International Application No. PCT/NO2007/000373.

Extended European Search Report issued in corresponding European Patent Application No. 07 83 4782 on Jun. 15, 2015.

* cited by examiner

SUB SEA PROCESSING SYSTEM

BACKGROUND OF THE INVENTION

1. Technical Field

The present invention relates to a sub sea processing system in connection with the production of oil and/or gas from one or more wells, especially wells producing heavy oil in deep water and with high viscosity.

2. Description of the Related Art

Oil and gas sub-sea field developments in deeper waters and closer to arctic areas face various technical challenges as a result of the more hostile environmental conditions. Overcoming these challenges requires a combination of careful and innovative design of production systems, and extensive and tightly controlled multi-phase flow assurance, as well as operational strategies and procedures. Design of sub-sea production systems normally begins with fluid characterization followed by establishment of a field architecture and development of economical flow-line configurations consistent with safety and minimum intervention requirements. Understanding and designing for the various flow assurance conditions and requirements of the deep water system may lead to minimum intervention and the least possible production loss. The performance goal for steady state operations should be to achieve platform arrival temperatures above hydrate formation temperatures and/or wax appearance temperature (WAT) as a minimum. The performance goal for transient, i.e. shut-in, operations is to achieve adequate, cool-down time before the pipe contents cool to the hydrate formation temperature after shut-in. Besides shut-in, depressurization and wax removal come into play as other major transient challenges in deeper waters.

Sub-sea pipeline bundles are commonly known and represent enhanced pipeline systems for the transportation of oil and gas and remote operation of sub-sea oil and gas wells. Such bundles may include a carrier pipe (outer casing or shell), within which may be provided one or more flow-lines for oil and gas, pipeline(s) or other arrangement for heating as well as hydraulic and/or electric control lines for the remote operation of the wells. This bundle solution may provide highly efficient thermal insulation and/or active heating elements to minimize thermal losses.

Bundle solutions are commonly used, among other situations, where the operation takes place in deep water, where seabed areas are congested, where diverless operations are mandatory or where anchor patterns restrict available seabed. However, bundle solutions as such do not solve the challenges associated with well operations in deep water with low temperature and production of heavy oil with high viscosity, but may be included in the solutions designed for such situations.

SUMMARY OF THE INVENTION

With the present invention is provided a sub sea processing system in connection with the production of oil and/or gas from one or more wells, especially wells producing heavy oil in deep water and with high viscosity. The system is designed to maintain preferred production temperature and is, in particular, designed to obtain required temperature conditions under start-up and shut-in.

BRIEF DESCRIPTION OF THE DRAWINGS

The present invention will be further described in the following by way of example and with reference to the figures, where.

DETAILED DESCRIPTION OF THE INVENTION

Figure 1:
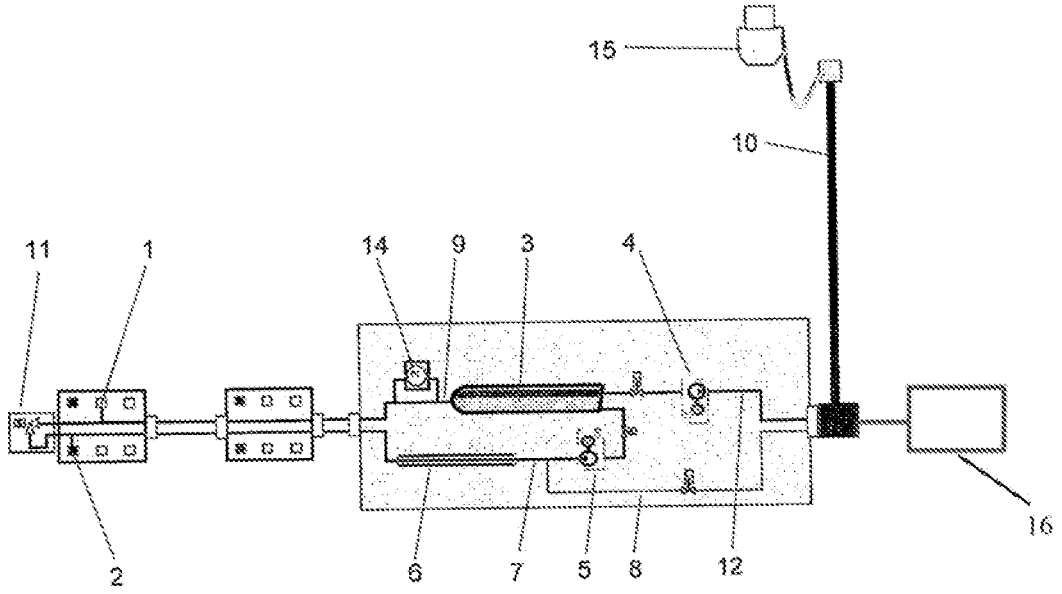
FIG. 1 is a principal sketch or scheme of a processing system according to the invention.

FIG. 1 shows, as stated above, a principal sketch or scheme of the processing system according to the invention. The system may include one or more production wells 1 for the production of oil and/or gas, one or more injection wells 2 for the injection of produced water, a flow control device 11, a separator 3, a production pump 4, a water injection and circulation pump 5, and a heating arrangement 6. The heating arrangement may preferably be in the form of an electrical heating system however, depending on the environmental situation, e.g. the surrounding temperature, sufficient heat may be provided through the work (heat energy) generated by the circulation pump 5.

Figure 2:
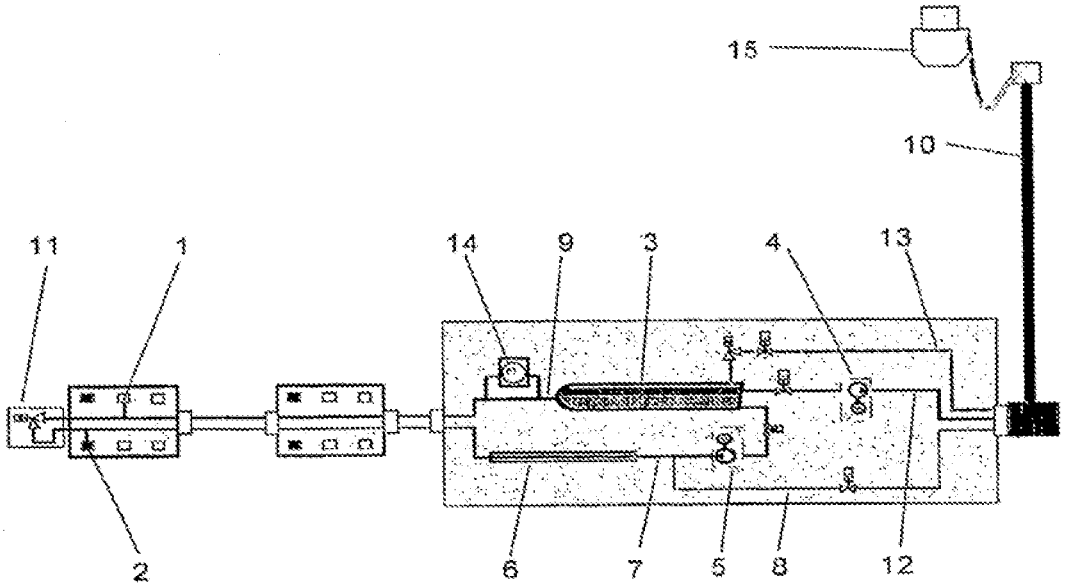
FIG. 2 is a principal sketch or scheme of an alternative processing system according to the invention.

The major feature of the invention is the provision of a water circulation and injection pipe loop 7 interconnecting the separator 3, the injection and circulation pump 5, the heating arrangement 6, the flow control device 11, and the wells 1 and 2. Water is initially added to the system through a water supply line 8 and is heated by the circulation pump and, if required, by the heating arrangement 6. The heated water is circulated by the circulation pump 5 to the injection well 2, further to the flow control device 11 and the production well 1 and thereafter to the separator 3, before finally being returned from the separator to the circulation pump 5. At start-up of the production wells the heated water in the pipe loop system prevents wax and/or hydrates from being deposited in the piping. Before starting production, the hot water gradually heats the well to the required start-up temperature to avoid any wax or hydrates, present in the produced oil, from being deposited in the well or production piping. Further, during start-up, produced well fluid will mix with the water in the loop and after a while, as production increases, reach steady state conditions. Thus produced fluid in the form of oil/water and possible gas flows through the production and circulation pipeline 9 to the separator 3 where the major parts of the hydrocarbons (oil and possible gas) are separated from the water. The produced oil and possible gas present in the fluid flow is transferred by means of the production pump 4 from the separator 3 to the desired destination 15 (a platform, production ship, trunk line, shore terminal etc.) via a production pipeline 12. Alternatively, as shown in FIG. 2, the oil and gas may be transported individually from the separator in separate oil and gas pipelines 12 and 13, respectively.

The produced water on the other hand is circulated from the separator 3 by the circulation pump 5 to the injection well 2 and/or to the flow control device 11. Further, based on the amount of produced water from the wells, additional injection water may be added to the circulation system through the water supply line 8 to maintain sufficient water for injection and to maintain the desired water cut conditions to obtain the best possible separation situation in the separator 3. A multiphase detection device 14 is provided prior to the separator 3 for measuring the amount of water present in the fluid flow ahead of the separator. Thus, water is added to the system through the supply line 8, the flow control device 11, or production/injection wellhead chokes adjusted accordingly based on these and other measurements.

At shut-in, when production of oil and gas is halted, circulation of water is maintained to keep the temperature at the desired level to avoid wax or hydrate deposits. If production is halted over a longer period of time, it may be appropriate to stop the circulation of water in the system. In such case, however, all of the oil in the circulation system should be evacuated and replaced by water and/or by a mixture of water and traditional inhibitors. Water or a water/inhibitor mixture should be injected into the production well to avoid depositions of wax and build up of hydrates in the upper parts of the production well being cooled down by the cold surroundings.

As indicated above any separator could be used to separate the water from the hydrocarbons in the system. However, a pipe separator may in some situations represent the desired choice due to separation performance and structural design. Thus, by using a pipe separator, the system as described above and including the separator 3, the heater 6, the pumps 4, 5 and the circulation and production piping 7, 8, 9 could easily fit within a bundle pipe arrangement which would make the system according to the invention quite compact and applicable for deep water installations.

The vertical column 10 on the right hand side of FIGS. 1 and 2 indicate a riser bundle that is connected to a production platform or ship etc. 15 and may include all required riser and supply lines such as the production lines 10, 13, the water supply line, gas lift lines and electrical cables etc.

The present invention, as defined in the claims, is not limited to the above examples and the attached figures. Thus, the system does not require the use of injection well(s) to handle produced water. Instead, the produced water could be handled by a disposal solution, for instance a disposal well.

The injection and production wells may be arranged as individual wells, template wells or bundle integral wells.

Further, the separator and pump station may constitute a separate modular installation or be integrated in the pipe-loop. Still further, the water supply to the system may be supplied by means of a separate water producing well 16.

The invention claimed is:

1. A sub-sea processing system for the production of oil and/or gas from one or more wells, the system comprising:

at least one production well for the production of oil and/or gas;

at least one injection or disposal well for the injection of produced water or produced water deposit(s);

a separator with an inlet and a plurality of outlets for water, oil and/or gas;

a water injection and circulation pump; and a flow control device, wherein a water circulation and injection pipe loop interconnects the separator, the injection and circulation pump, the flow control device, the at least one production well and the at least one injection or disposal well, and said loop circulates hot water to control the temperature of the fluid flow in said loop, thereby controlling the viscosity and the water cut in the fluid flow entering the separator prior to start up and during production of any of the wells.

2. The sub-sea processing system according to claim 1, wherein the injection, or disposal, and production wells are arranged as individual wells, template wells or bundle integral wells.

3. The sub-sea processing system according to claim 1, wherein the separator and water injection and circulation pump are integrated in the pipe-loop.

4. The sub-sea processing system according to claim 1, wherein a production pump is provided at the outlet end of the separator to transfer the produced oil and gas to a desired destination via a production pipeline.

5. The sub-sea processing system according to claim 1, wherein a separate gas production line is provided for the evacuation of the produced gas.

6. The sub-sea processing system according to claim 1, further comprising a separate water producing well for supplying water.

7. The sub-sea processing system according to claim 1, wherein the flow control device is provided between the injection or disposal well and the production well.

8. The sub-sea processing system according to claim 1, wherein the system includes a plurality of production wells and a plurality of injection or disposal wells.

9. The sub-sea processing system according to claim 1, wherein the at least one production well is capable of producing heavy oil with high viscosity in deep water.

10. The subsea processing system according to claim 1, further comprising a heating arrangement, wherein the pipe loop interconnects the separator, the injection and circulation pump, the heating arrangement, the flow control device, the at least one production well and the at least one injection or disposal well.

11. A sub-sea processing system for the production of oil and/or gas from one or more wells, the sub-sea system comprising:

at least one production well producing gas and/or heavy oil with high viscosity in deep water;

at least one injection or disposal well for the injection of produced water or produced water deposit(s);

a separator with an inlet and a plurality of outlets for water, oil and/or gas;

a water injection and circulation pump;

a heating arrangement; and a flow control device; and wherein a water circulation and injection pipe loop interconnects the separator, the injection and circulation pump, the heating arrangement, the flow control device, the at least one production well, and the at least one injection or disposal well, and said loop circulates hot water to control the temperature of the fluid flow in said loop, thereby controlling the viscosity and the water cut in the fluid flow entering the separator prior to start up and during production of any of the wells.

12. The sub-sea processing system according to claim 11, wherein the injection, or disposal, and production wells are arranged as individual wells, template wells or bundle integral wells.

13. The sub-sea processing system according to claim 11, wherein the separator and water injection and circulation pump are integrated in the pipe-loop.

14. The sub-sea processing system according to claim 11, wherein a production pump is provided at the outlet end of the separator to transfer the produced oil and gas to a desired destination via a production pipeline.

15. The sub-sea processing system according to claim 11, wherein a separate gas production line is provided for the evacuation of the produced gas.

16. The sub-sea processing system according to claim 11, further comprising a separate water producing well for supplying water.

17. The sub-sea processing system according to claim 11, wherein the flow control device is provided between the injection or disposal well and the production well.

18. The sub-sea processing system according to claim 11, wherein the system includes a plurality of production wells and a plurality of injection or disposal wells.

* * * * *